US007766176B2

(12) United States Patent
Pech

(10) Patent No.: US 7,766,176 B2
(45) Date of Patent: Aug. 3, 2010

(54) MOBILE LIFT CRANE WITH LIFT ENHANCING ATTACHMENT

(75) Inventor: David J. Pech, Manitowoc, WI (US)

(73) Assignee: Manitowoc Crane Companies, LLC, Manitowoc, WI (US)

( * ) Notice: Subject to any disclaimer, the term of this patent is extended or adjusted under 35 U.S.C. 154(b) by 0 days.

(21) Appl. No.: 12/268,868

(22) Filed: Nov. 11, 2008

(65) Prior Publication Data

US 2010/0116766 A1 May 13, 2010

(51) Int. Cl.
*B66C 23/76* (2006.01)

(52) U.S. Cl. ..... 212/196; 212/301

(58) Field of Classification Search ..... 212/196, 212/301

See application file for complete search history.

(56) References Cited

U.S. PATENT DOCUMENTS

| | | | | |
|---|---|---|---|---|
| 3,868,022 | A | 2/1975 | Greenlay et al. | |
| 4,349,115 | A | 9/1982 | Lampson | |
| 4,358,021 | A * | 11/1982 | Helm et al. | 212/195 |
| 4,382,519 | A | 5/1983 | Beduhn et al. | |
| 4,387,814 | A | 6/1983 | Beduhn et al. | |
| 4,508,232 | A | 4/1985 | Lampson | |
| 4,537,317 | A * | 8/1985 | Jensen | 212/301 |

(Continued)

FOREIGN PATENT DOCUMENTS

EP 0 048 076 3/1982

OTHER PUBLICATIONS

Model 2250 Product Guide, Manitowoc Crane, pp. 1-9, 46-47, 60-65 (2000).

(Continued)

*Primary Examiner*—Thomas J. Brahan
(74) *Attorney, Agent, or Firm*—Brinks Hofer Gilson & Lione; Steven P. Shurtz

(57) ABSTRACT

A mobile lift crane includes a central crane unit, a boom unit and a counterweight unit. The central crane unit has a carbody, moveable ground engaging members and a rotating bed mounted to the ground engaging members with a rotatable connection such that the rotating bed can swing with respect to the ground engaging members. The boom unit has a support member, at least one moveable ground engaging member, and a boom pivotally mounted on the support member. The counterweight unit has counterweight on a support member. Rigging connects the boom and counterweight unit such that a load lifted by the boom can be counterbalanced by the counterweight. The boom unit and counterweight unit are connected to the central crane unit by structural members that carry compressive loads and maintain the boom unit, the rotating bed and the counterweight unit in lateral alignment with each other, but allow relative vertical movement between the boom unit, the rotating bed and the counterweight unit. A main mast is pivotally mounted on the combination of the central crane unit, the boom unit and the structural member between the central crane unit and the boom unit. In another embodiment, a counterweight unit with a swing axis and boom unit are connected directly together with a structural member. Ground engaging members on the boom unit can be rotated relative to a boom unit support member such that the boom unit i) can travel in an arc around the swing axis of the counterweight unit and ii) travel in direction in line with the structural member.

16 Claims, 7 Drawing Sheets

U.S. PATENT DOCUMENTS

| | | | | |
|---|---|---|---|---|
| 4,540,097 | A | 9/1985 | Wadsworth et al. | |
| 4,579,234 | A | 4/1986 | Delago et al. | |
| 4,614,275 | A * | 9/1986 | Zenno | 212/198 |
| 4,953,722 | A | 9/1990 | Becker et al. | |
| 5,522,515 | A | 6/1996 | Pech et al. | |
| 5,941,401 | A | 8/1999 | Petzold et al. | |
| 6,283,315 | B1 | 9/2001 | Willim et al. | |
| 6,360,905 | B1 | 3/2002 | Frommelt et al. | |
| 6,474,487 | B1 | 11/2002 | Kretschmer | |
| 6,516,961 | B1 * | 2/2003 | Knecht et al. | 212/301 |
| 7,370,767 | B2 * | 5/2008 | Roodenburg et al. | 212/178 |

OTHER PUBLICATIONS

Model 18000 Product Guide, Manitowoc Crane, pp. 1-9, 45-48 (2008).

Model 21000 Product Guide, Manitowoc Crane, pp. 1-8, 26-35 (2000).

Pictures of Manitowoc Crane X-Tender, 4 pages (undated, but prior to May 12, 2006).

Pictures of Manitowoc Crane MAXER (various embodiments), 4 pages (undated, but prior to May 12, 2006).

* cited by examiner

MOBILE LIFT CRANE WITH LIFT ENHANCING ATTACHMENT

REFERENCE TO EARLIER FILED APPLICATIONS

The present application claims the benefit of the filing date under 35 U.S.C. §120 of PCT patent application Ser. No. PCT/US07/068738, filed May 11, 2007; and also claims the benefit of the filing date under 35 U.S.C. §119(e) of Provisional U.S. Patent Application Ser. No. 60/799,915; both of which are hereby incorporated by reference in their entirety.

BACKGROUND

The present application relates to lift cranes, and particularly to mobile lift cranes having attachments to increase the lift capacity of the crane.

Enhancing the lift capacities of mobile lift cranes has been the subject of many improvements in the art of lift cranes over the years. Even with these improvements, there is still a need for further improvements, especially where the particular load to be lifted is very heavy, and other constraints associated with the load come into play, such as the need for the crane to be able to move over the ground while lifting the load.

BRIEF SUMMARY

A mobile lift crane has been invented which is capable of making very heavy lifts and still being mobile while lifting the load. In a first aspect, the invention is a mobile lift crane comprising a central crane unit having a carbody, moveable ground engaging members and a rotating bed mounted to the ground engaging members with a rotatable connection such that the rotating bed can swing with respect to the ground engaging members; a boom unit having a support member, a boom pivotally mounted on the support member, and at least one moveable ground engaging member mounted on the support member so that the weight of the boom is supported by the boom unit moveable ground engaging member, and whereby the boom, boom support and boom unit moveable ground engaging member all travel together as a single unit; a counterweight unit having counterweight on a support member; and rigging connecting the boom and counterweight unit such that a load lifted by the boom can be counterbalanced by the counterweight. The boom unit and counterweight unit are connected to the central crane unit by structural members that car-y compressive loads and maintain the boom unit, the rotating bed and the counterweight unit in lateral alignment with each other, but allow relative vertical movement between the boom unit, the rotating bed and the counterweight unit. A main mast is pivotally mounted on the combination of the central crane unit, the boom unit and the structural member between the central crane unit and the boom unit.

In a second aspect, the invention is a mobile lift crane comprising a counterweight unit having a support member, counterweight, and at least two moveable ground engaging members, the support member being mounted to the ground engaging members with a rotatable connection such that the support member can swing with respect to the ground engaging members about a swing axis; a boom unit having a support member, at least two moveable ground engaging members, a boom pivotally mounted on the support member, and a main mast pivotally mounted on the support member; a structural member between the boom unit and the counterweight unit that can carry compressive loads and maintain the boom unit and the counterweight unit in lateral alignment with each other, but allow relative vertical movement between the boom unit and the counterweight unit; and rigging connecting the boom, mast and counterweight unit such that a load lifted by the boom can be counterbalanced by the counterweight. The ground engaging members of the boom unit can be rotated relative to the boom unit support member such that the boom unit i) can travel in an arc around the swing axis and ii) travel in direction in line with the structural member.

With one embodiment of the lift crane of the present invention, the crane with a short boom and short radii will be able to lift approximately 2,000 metric ton. In a configuration like that shown in the attached FIGS. 1-3, the capacity is approximately 800 metric ton. Even with the ability to lift these large loads, the crane is still mobile.

These and other advantages of the invention, as well as the invention itself, will be more easily understood in view of the attached drawings.

DETAILED DESCRIPTION OF THE DRAWINGS AND THE PRESENTLY PREFERRED EMBODIMENTS

Figure 1:
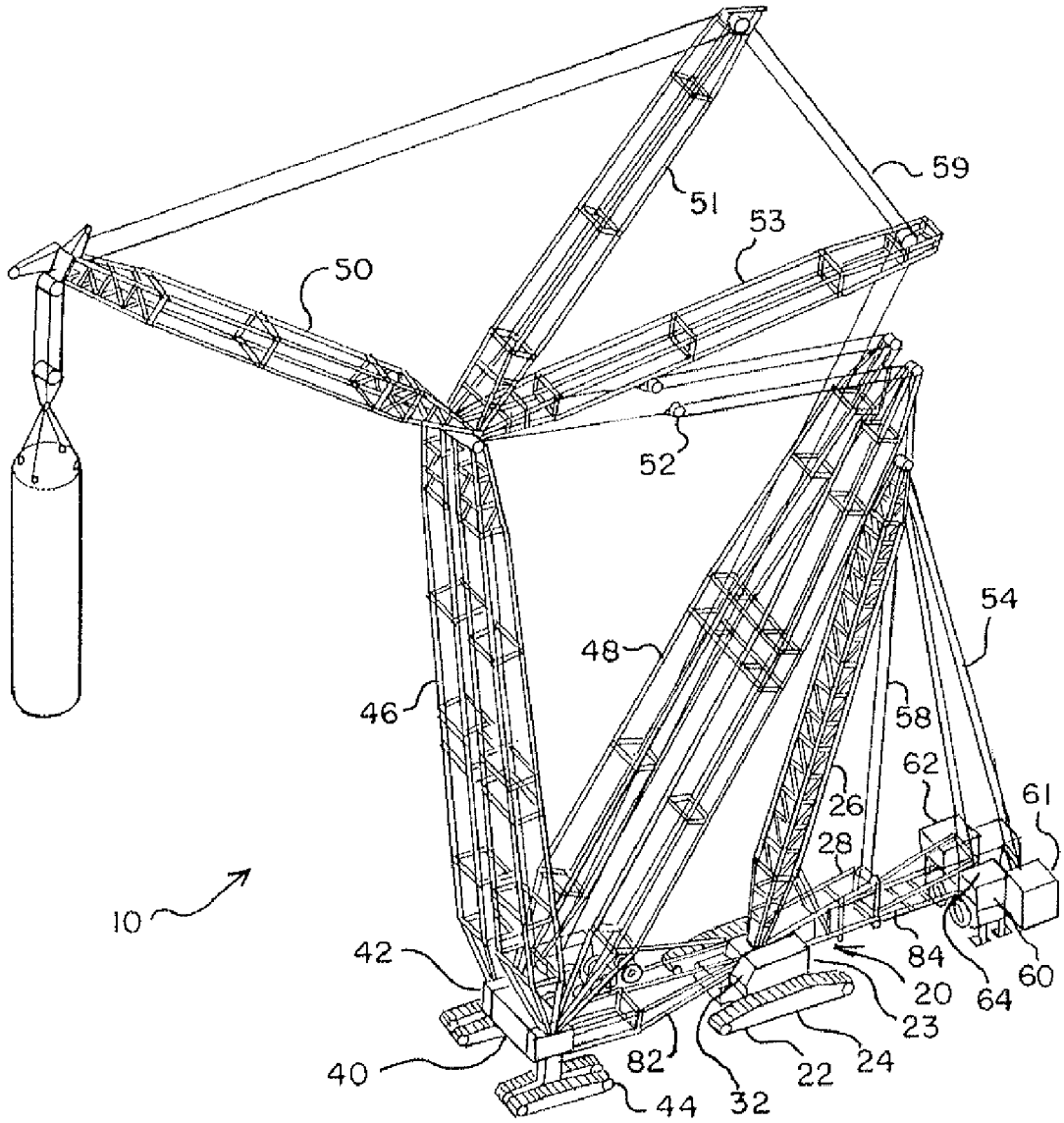
FIG. 1 is a perspective view of a first embodiment of a mobile lift crane with lift enhancing attachments.

The present invention will now be further described. In the following passages, different aspects of the invention are defined in more detail. Each aspect so defined may be combined with any other aspect or aspects unless clearly indicated to the contrary. In particular, any feature indicated as being preferred or advantageous may be combined with any other feature or features indicated as being preferred or advantageous.

Three embodiments of the invention are shown in the attached drawings. In the first embodiment, shown in FIGS. 1-3, the mobile lift crane 10 is made from three main units: a central crane unit 20, a boom unit 40 and a counterweight unit 60. The boom unit 40 and counterweight unit 60 are connected to the central crane unit 20 by structural members 82 and 84. The boom unit 40 and its structural member 82 are similar to a lift enhancing attachment that has been sold under the trademark "X-Tender" by Manitowoc Cranes of Manitowoc, Wis. The counterweight unit 60 and its structural member 84 are similar to another lift enhancing attachment that has been sold under the trademark "MAX-ER" by Manitowoc Cranes. However, up until the present invention, it is believed that no one had ever combined the two attachment concepts to achieve a very high lift capacity crane. Having the swing axis longitudinally located between the combined enhancing devices is unique and non-obvious. Because many features of the boom unit, central crane unit and counterweight unit are the same as in cranes and these attachments, they will not be described in detail herein.

The central crane unit 20 includes a carbody 22, a rotating bed 23 and moveable ground engaging members in the form of crawlers 24. The rotating bed 23 is mounted to the carbody 22 with a rotatable connection, which may be rollers running on a roller path or a slewing ring, such that the rotating bed 23 can swing about a vertical axis with respect to the ground engaging members 24. In the crane 10, the ground engaging members on the central crane unit comprise at least two crawlers. The central crane unit further includes a secondary mast 26 pivotally connected to the rotating bed 23. This mast is used primarily during set up to raise the main mast. The central crane unit 20 also includes other elements commonly found on a mobile lift crane, such as a live mast 28, back stops 30 and an operator's cab 32.

Figure 2:
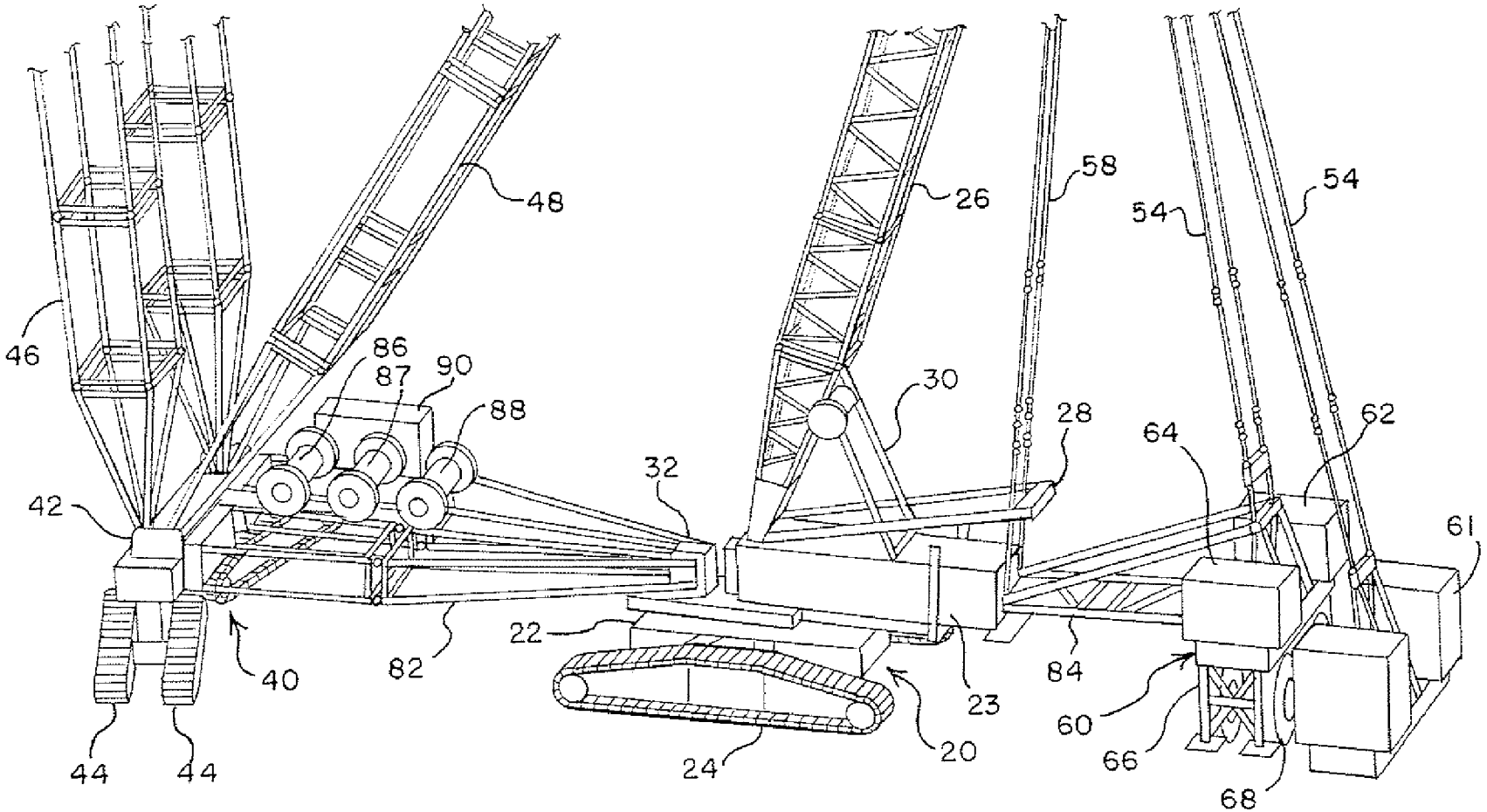
FIG. 2 is a partial perspective view of the mobile lift crane of FIG. 1 with some elements removed for sake of clarity.
Figure 3:
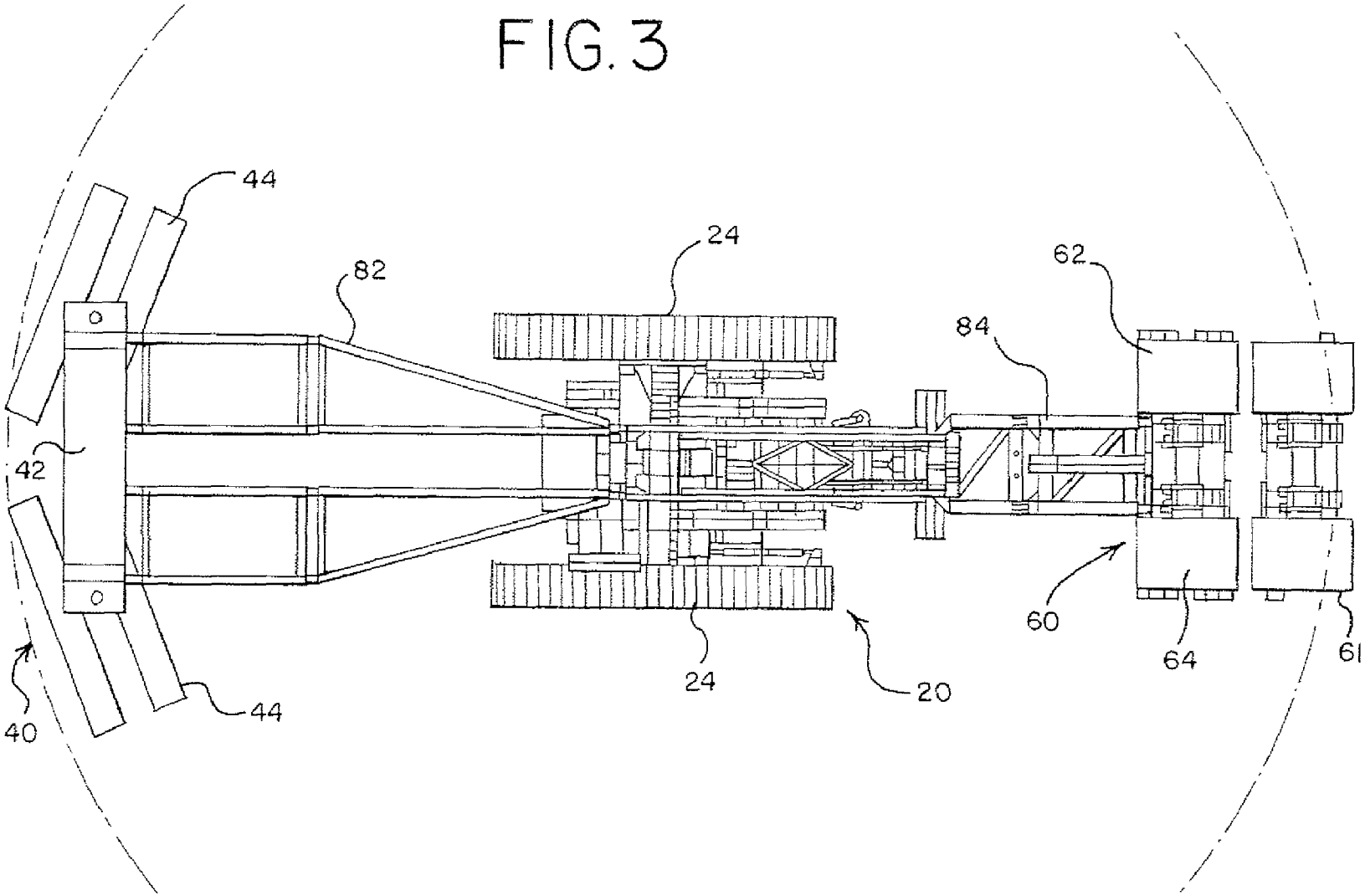
FIG. 3 is a top plan view of the mobile lift crane of FIG. 1 with some elements removed for sake of clarity.

The boom unit 40 includes a support member 42 and at least one moveable ground engaging member. The ground engaging member on the boom unit will typically comprise at least two crawlers. In the embodiment shown, the boom unit has four moveable ground engaging members in the form of crawlers 44, in two sets of two crawlers each. Each of crawlers (or in this case, each set of crawlers) on the boom unit can be rotated about a vertical axis so that the boom unit can travel in both i) an arc around the axis of the rotatable swing connection of the central crane unit 20 (as shown in FIGS. 2 and 3) and ii) a lateral direction corresponding to a linear direction of travel of the central crane unit (as shown in FIG. 1).

The boom unit also includes a boom 46 pivotally mounted on the support member 42, and a main mast 48 pivotally mounted on the support member 42. The boom 46 may comprises a main boom and a luffing jib 50 pivotally mounted to the top of the main boom. When a luffing jib 50 is included, struts 51 and 53 are also used. The boom may be made from two independent lattice structures that are joined together at both their tops and bottoms by the pivotal support mechanism of the support member 42 and the luffing jib support on the top of the main boom.

The counterweight unit 60 includes a counterweight (which may be in the form of two stacks 62 and 64 of individual counterweight members as shown) on a support member 66. The counterweight unit 60 further includes moveable ground engaging members in the form of multiple wheels 68. In the embodiment shown a second counterweight unit 61, designed for free-hanging use, is also included. The ground engaging members on the counterweight unit can be rotated about a vertical axis so that the counterweight unit can travel in both i) an arc around the axis of the rotatable swing connection of the central crane unit and ii) a lateral direction corresponding to a linear direction of travel of the central crane unit. The counterweight unit 61 may include a hydraulic cylinder (not shown) connected between the support member and the back hitch straps 54 that can be retracted to change the bearing of the counterweight from the ground to the back hitch straps as a load is lifted and counterweight is needed.

The crane 10 also includes rigging connecting the boom 46, main mast 48 and counterweight unit 60 such that a load lifted by the boom 46 can be counterbalanced by the counterweight. The rigging includes boom hoist rigging 52 between the main mast 48 and the boom 46, allowing the boom angle with respect to the ground to be changed. The rigging also includes the back hitch straps 54. The back hitch straps in the embodiment shown are ultimately tied to the main mast 48, but may also be connected through the top of the secondary mast 26. In the embodiment shown there are two sets of back hitch straps 54, one tied to the counterweight unit 60 and one tied to the second counterweight unit 61. Another back hitch strap 58 is tied to the back of the central crane unit 20. This strap is also tied to the live mast 28 and is used to erect the secondary mast 26. Rigging 59 (FIG. 1) is used to change the angle between struts 51 and 53, and thus the angle of luffing jib 50 compared to the main boom.

The structural members 82 and 84 carry compressive loads and maintain the boom unit 40, the rotating bed 23 and the counterweight unit 60 in lateral alignment with each other. However, these members are pinned so as to allow relative vertical movement between the boom unit 40, the rotating bed 23 and the counterweight unit 60. The structural member 82 may support one or more drums 86, 87 and 88 containing a load hoist line, luffing jib line 59 and boom hoist line, as well as engine module 90.

Figure 4:
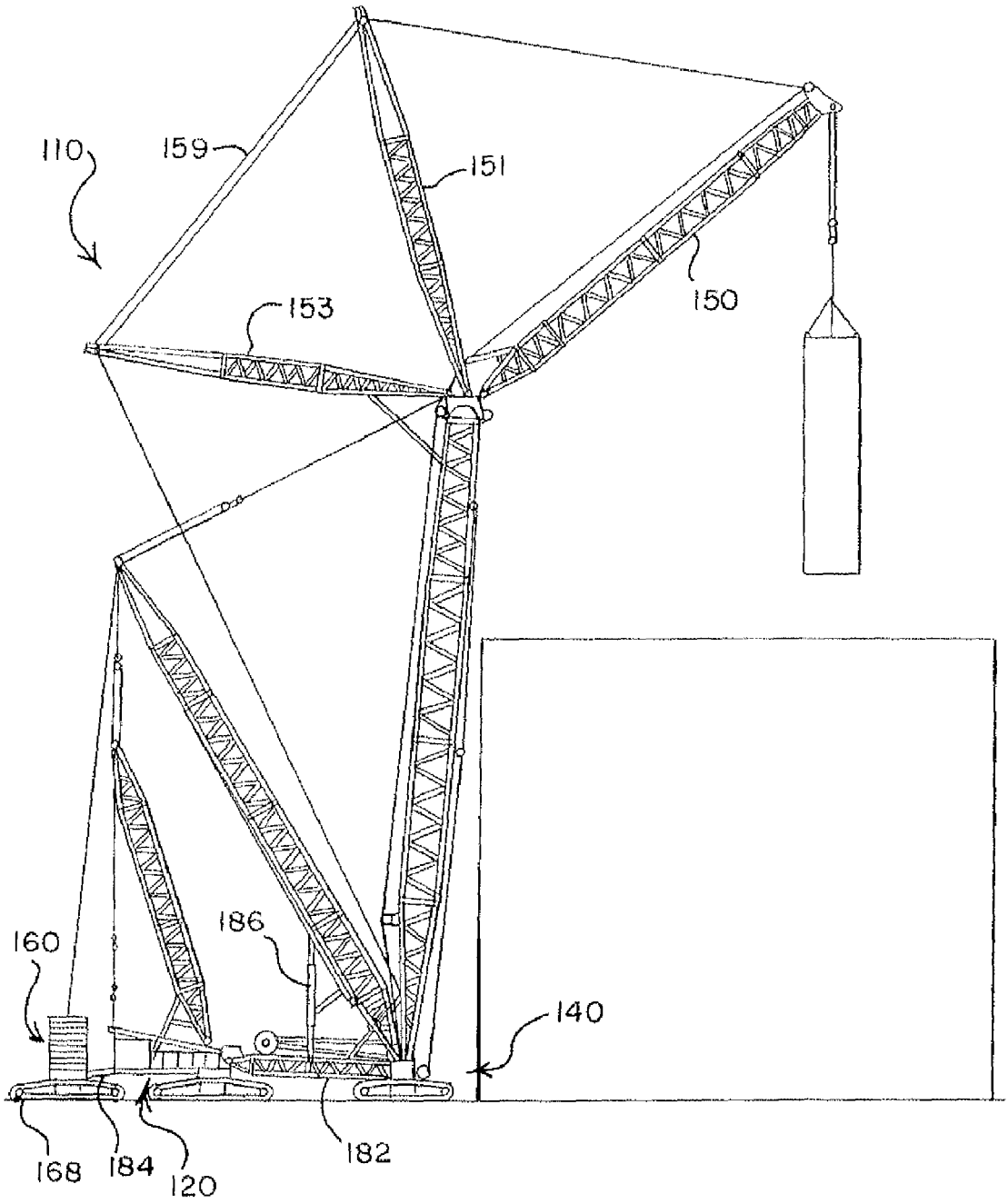
FIG. 4 is a side elevational view of a second embodiment of a mobile lift crane of the present invention.
Figure 5:
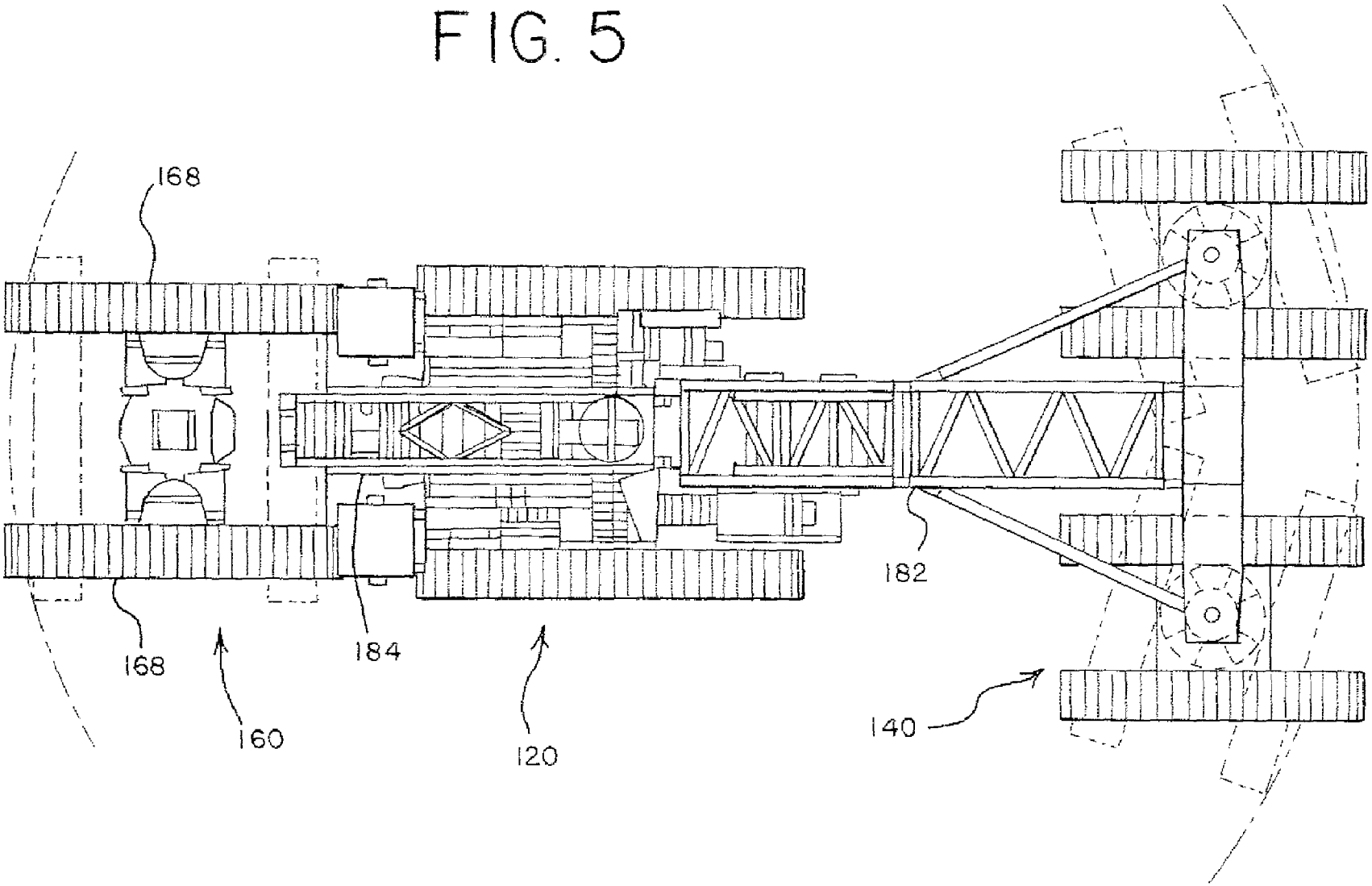
FIG. 5 is a top plan view of the crane of FIG. 4 with some elements removed for sake of clarity.

FIGS. 4 and 5 show a second embodiment of a crane 110 of the present invention. Like the crane 10, crane 110 includes three main units: a central crane unit 120, a boom unit 140 and a counterweight unit 160. The boom unit 140 and counterweight unit 160 are connected to the central crane unit 120 by structural members 182 and 184. Rigging 159 is used to change the angle between struts 151 and 153, and thus the angle of the luffing jib 150. Load hoist line and rigging drums, as well as an engine module, are mounted on the structural member 182. The mast back stop 186 shown in FIG. 4 can also be used on crane 10. The primary difference in the crane 110 compared to crane 10 is that the moveable ground engaging members on the counterweight unit 160 comprise at least two crawlers 168. FIG. 5 shows the crawlers 168 and the crawlers on the boom unit in the orientation for swinging about the central crane unit in phantom lines.

Figure 6:
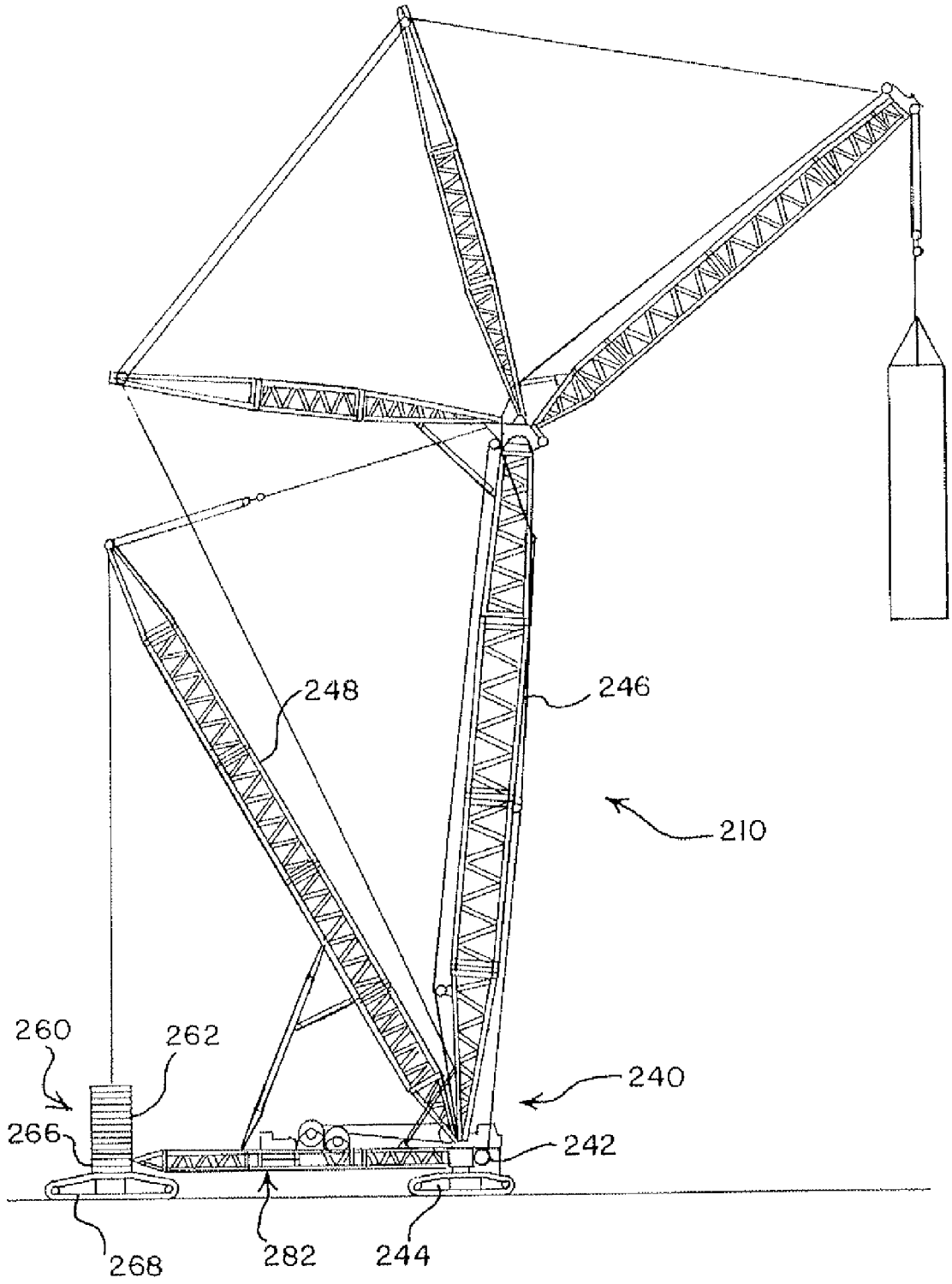
FIG. 6 is a side elevational view of a third embodiment of a mobile lift crane of the present invention.
Figure 7:
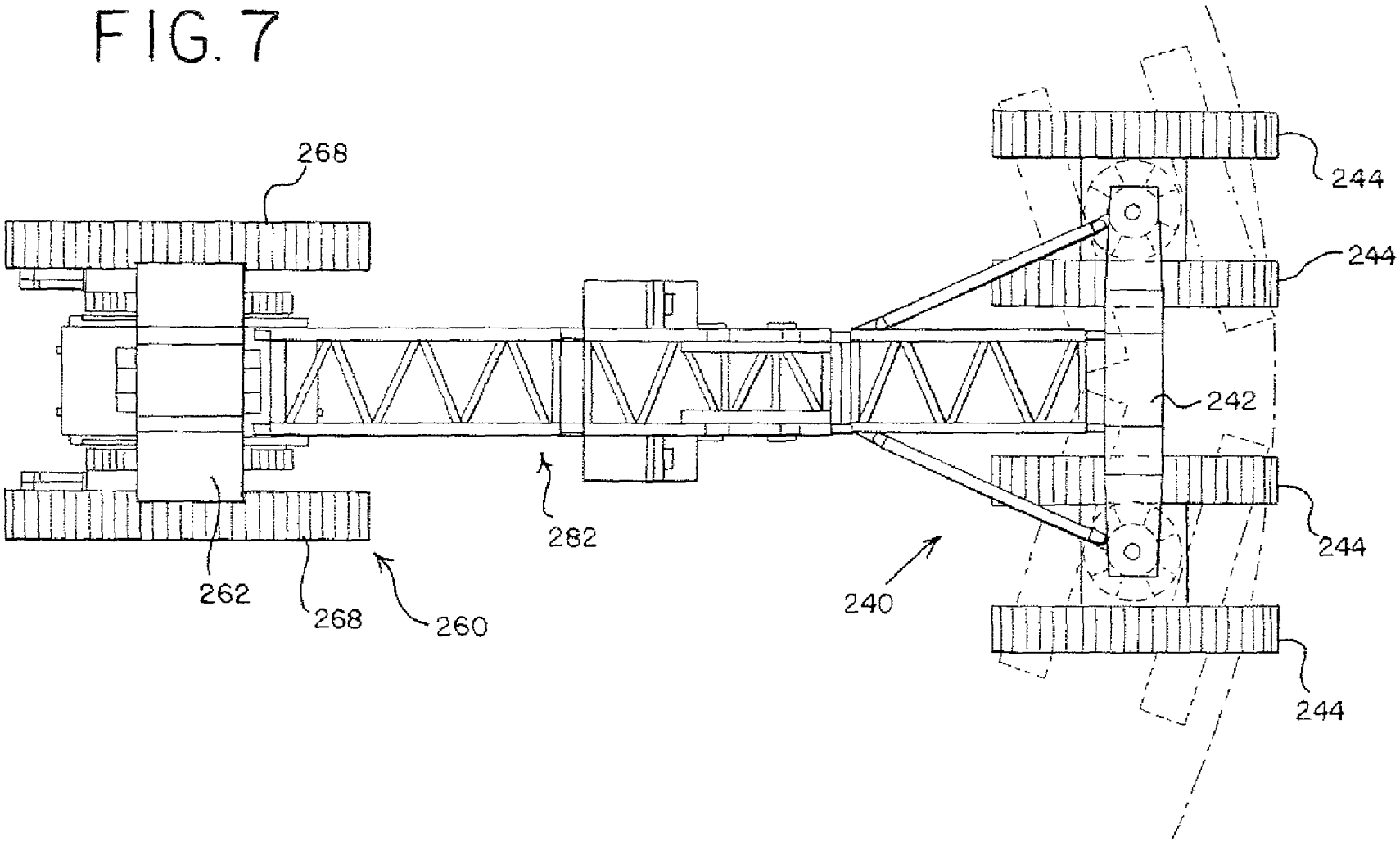
FIG. 7 is a top plan view of the crane of FIG. 6 with some elements removed for sake of clarity.

FIGS. 6 and 7 show a third embodiment of a crane 210. This crane is different than cranes 10 and 110 in that it has only two main units: a counterweight unit 260 and a boom unit 240. In this embodiment, the counterweight unit is designed to have a central swing axis and the boom unit is configured so that it can either move in an arc about that swing axis, or travel in line with the crawlers on the counterweight unit.

The counterweight unit 260 includes a support member 266, counterweight 262 and at least two moveable ground engaging members in the form of two crawlers 268. The support member 266 is mounted to the ground engaging members with a rotatable connection such that the support member 266 can swing with respect to the ground engaging members about a swing axis.

The boom unit 240 includes a support member 242, at least two moveable ground engaging members, in this case four crawlers 244, a boom 246 pivotally mounted on the support member 242, and a main mast 248 pivotally mounted on the support member. A structural member 282 extends between the boom unit and the counterweight unit, and can carry compressive loads and maintain the boom unit and the counterweight unit in lateral alignment with each other, but allows relative vertical movement between the boom unit and the counterweight unit. The crane 210 also includes rigging connecting the boom, mast and counterweight unit such that a load lifted by the boom can be counterbalanced by the counterweight. The ground engaging members 244 of the boom unit can be rotated relative to the boom unit support member such that the boom unit i) can travel in an arc around the swing axis of the counterweight unit (as shown in phantom lines in FIG. 7) and ii) travel in direction in line with the structural member 282.

It should be understood that various changes and modifications to the presently preferred embodiments described herein will be apparent to those skilled in the art. For example, instead of the main mast 46 being mounted on the boom support member 42, it could be pivotally mounted elsewhere on the combination of the central crane unit 20, the boom unit 40 and the structural member 82 between the central crane unit and the boom unit. The drums for the hoist line and rigging could be mounted on the rotating bed of the central crane unit. Such changes and modifications can be made without departing from the spirit and scope of the present invention and without diminishing its intended advantages. It is therefore intended that such changes and modifications be covered by the appended claims.

The invention claimed is:

1. A mobile lift crane comprising:

a) central crane unit having a carbody, moveable ground engaging members and a rotating bed mounted to the carbody with a rotatable connection such that the rotating bed can swing with respect to the ground engaging members;

b) a boom unit having a boom support member, a boom pivotally mounted on the boom support member, and at least one moveable ground engaging member mounted on the boom support member so that the weight of the boom is supported by the boom unit moveable ground engaging member, and whereby the boom, boom support member and boom unit moveable ground engaging member all travel together as a single unit;

c) a counterweight unit having counterweight on a counterweight support member and moveable ground engaging members mounted on the counterweight support member; and d) rigging connecting the boom and counterweight unit such that a load lifted by the boom can be counterbalanced by the counterweight;

e) wherein the boom unit is connected to the central crane unit by a first structural member and the counterweight unit is connected to the central crane unit by a second structural member, wherein both the first and second structural members carry compressive loads and maintain the boom unit, the rotating bed and the counterweight unit in lateral alignment with each other, but allow relative vertical movement between the boom unit, the rotating bed and the counterweight unit, and wherein the crane further comprises a main mast pivotally mounted on the combination of the central crane unit, the boom unit and the first structural member.

2. The mobile lift crane of claim 1 wherein the ground engaging members on the central crane unit comprise at least two crawlers.

3. The mobile lift crane of claim 1 wherein the ground engaging member on the boom unit comprise at least two crawlers.

4. The mobile lift crane of claim 3 wherein the at least two crawlers on the boom unit comprise two sets of two crawlers each.

5. The mobile lift crane of claim 3 wherein each of crawlers on the boom unit can be rotated about a vertical axis so that the boom unit can travel in both i) an arc around the axis of the rotatable swing connection of the central crane unit and ii) a lateral direction corresponding to a linear direction of travel of the central crane unit.

6. The mobile lift crane of claim 1 wherein the moveable ground engaging members on the counterweight unit comprise a plurality of wheels.

7. The mobile lift crane of claim 1 wherein the moveable ground engaging members on the counterweight unit comprise at least two crawlers.

8. The mobile lift crane of claim 1 wherein the main mast is pivotally mounted on the boom support member of the boom unit.

9. The mobile lift crane of claim 8 wherein the central crane unit further comprises a secondary mast pivotally connected to the rotating bed.

10. The mobile lift crane of claim 1 wherein the boom comprises a main boom and a luffing jib pivotally mounted to the top of the main boom.

11. The mobile lift crane of claim 1 further comprising a drum containing a load hoist line, the drum being mounted on the first structural member.

12. The mobile lift crane of claim 1 wherein the boom comprises two independent lattice structures that are joined together at both their tops and bottoms.

13. The mobile lift crane of claim 1 wherein the rigging comprises i) boom hoist rigging between the main mast and the boom allowing the boom angle to be changed and ii) back hitch straps between the main mast and the counterweight unit.

14. The mobile lift crane of claim 1 further comprising a second counterweight unit.

15. The mobile lift crane of claim 14 wherein the second counterweight unit is configured for free-hanging use.

16. The mobile lift crane of claim 1 wherein the ground engaging members on the counterweight unit can be rotated about a vertical axis so that the counterweight unit can travel in both i) an arc around the axis of the rotatable swing connection of the central crane unit and ii) a lateral direction corresponding to a linear direction of travel of the central crane unit.

* * * * *